US005678112A

United States Patent [19]

Bernard et al.

[11] Patent Number: 5,678,112

[45] Date of Patent: Oct. 14, 1997

[54] METHOD AND DEVICE FOR PROCESSING A PHOTOGRAPHIC FILM

[75] Inventors: Patrick Eugene Yvon Bernard, Chagny; Guy André Jean Manas, St. Jean, both of France

[73] Assignee: Eastman Kodak Company, Rochester, N.Y.

[21] Appl. No.: 684,534

[22] Filed: Jul. 19, 1996

[30] Foreign Application Priority Data

Jul. 20, 1995 [FR] France ..... 95 09044

[51] Int. Cl.[6] ..... G03D 3/02

[52] U.S. Cl. ..... 396/565; 396/626

[58] Field of Search ..... 396/626, 630, 396/631, 565; 430/398–400, 567, 569; 210/636, 641, 644, 651, 652, 321.64; 136/64 P, 122 P

[56] References Cited

U.S. PATENT DOCUMENTS

| | | | |
|---|---|---|---|
| 3,782,953 | 1/1974 | Maley et al. | 430/569 |
| 4,160,594 | 7/1979 | Geyken et al. | 346/626 |
| 4,334,012 | 6/1982 | Mignot | 430/567 |
| 4,451,132 | 5/1984 | Kishimoto | 396/626 |
| 4,758,505 | 7/1988 | Hoffmann | 430/569 |
| 4,792,401 | 12/1988 | Truex et al. | 210/644 |
| 4,846,976 | 7/1989 | Ford | 210/636 |
| 4,987,438 | 1/1991 | Goto et al. | 396/626 |
| 5,164,092 | 11/1992 | Munch | 210/641 |
| 5,502,534 | 3/1996 | Lynch et al. | 396/624 |

FOREIGN PATENT DOCUMENTS

| | | | |
|---|---|---|---|
| 2684024 | 5/1993 | France | B01D 61/58 |

*Primary Examiner*—D. Rutledge
*Attorney, Agent, or Firm*—John R. Everett

[57] ABSTRACT

The invention concerns a method and a device for processing a photographic film.

The process comprises the following steps: a) circulating the film (2) in a series of processing baths (5, 6, 7, 8), each of the baths having a rinsing zone (53, 62, 73, 82) including one or more tanks; b) recovering and treating the waste water coming from all the rinsing zones in a single nanofiltration device (100), common to all the processing baths; and c) recycling the permeate (106) from the nanofiltration device (100) in each of the rinsing zones (43, 62, 73, 82) of each of the processing baths (5, 6, 7, 8).

Application to the processing of photographic films.

7 Claims, 1 Drawing Sheet

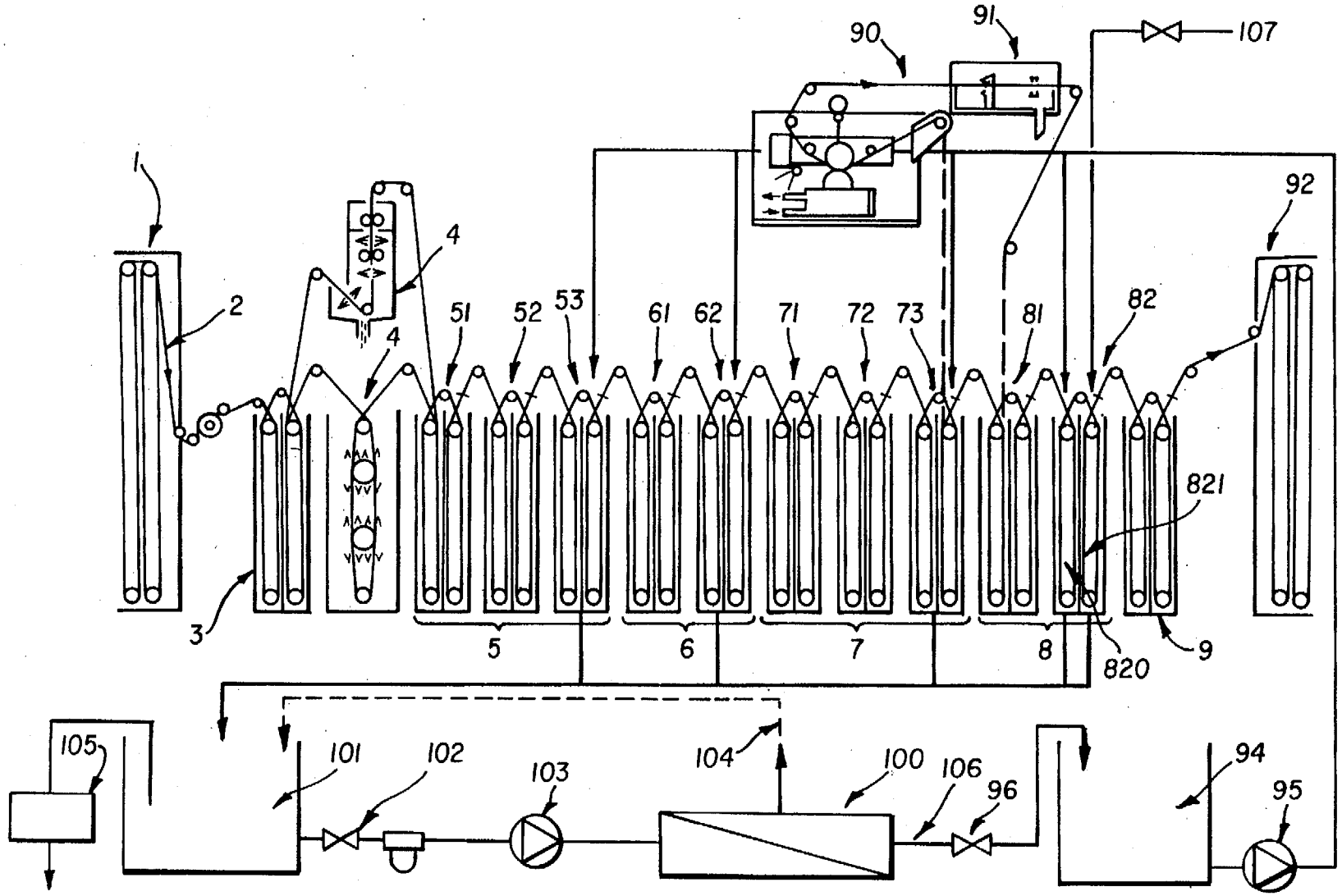
107
91
90
92
82
81
821
9
820
8
73
72
71
7
62
61
6
53
52
51
5
4
4
2
1
3
95
94
96
106
100
104
103
102
101
105

METHOD AND DEVICE FOR PROCESSING A PHOTOGRAPHIC FILM

FIELD OF THE INVENTION

The invention concerns the processing of photographic films and concerns in particular the recycling washing waters from the processing baths.

BACKGROUND OF THE INVENTION

Many manufacturing or conversion processes produce waste water which on the one hand cannot be discharged directly to the drains because of their composition and on the other hand contain precious substances whose recovery and reuse would present economic advantages. The example of the photographic processing industry can be cited, in which exposed photographic papers and films pass through several processing baths, after which the chemical products must to a great extent be removed from the finished products. Such methods of processing photographic films are well known (see for example Chimie et Physique Photographiques; Pierre Glafkides; Vol 2; Chap XL, pages 947–967) and consequently do not require any additional description. These processes produce washing waters which contain, in relatively low concentrations, chemical products which were very expensive to separate with the processes known up till now.

According to a first known approach, the processing of the used water from photographic baths takes place in two stages, the salts being eliminated from the solution by ion exchange and the organic chemical products by absorption, for example using activated carbon. By means of a subsequent process using additional chemical products, the substances eliminated from the solutions must then once again be separated from the resins used for the elimination, or from the activated carbon. Evaporation or distillation are also used for the separation of dissolved substances. However, for highly dilute substances, these processes are expensive because of the high expenditure of energy which they involve.

According to a second, more recent approach, recourse was had to ultrafiltration or nanofiltration for the treatment of the waste water. According to this approach, each of the processing baths in an installation is connected to its own ultrafiltration or nanofiltration unit. In general, such units are in the form of membranes, behaving in principle as sieves with a large surface area and having, byway of "holes", pores of microscopic or molecular size, whose dimensions must be very regular in order for molecules, as from a defined size, to be retained whilst smaller molecules or simple salt ions pass through the membrane. The membranes for ultrafiltration generally allow molecules to pass whose molecular weight is less than approximately 2000, whilst the molecules whose molecular weight is higher are retained. With nanofiltration, this limit is situated at a molecular weight of approximately 200. Membranes for nanofiltration of this type are characterized by high selectivity even if otherwise they allow lower flow rates. In general, one filtration unit per treatment bath is used so that there is a first unit for the treatment of the waste water coming from the developing bath, a second unit for the fixing bath, a third unit for the bleaching bath, etc, the permeate coming from each of the filtration units being recycled exclusively in the rinsing zone of the bath associated with this filtration zone. Such systems are widely described in patent literature, and in particular in the patents U.S. Pat. No. 4,451,132 and FR-A-2 684 024.

The major drawbacks of these installations lies principally in the fact that the multiplication of the ultrafiltration or nanofiltration units increases the cost, size and maintenance of these processing installations accordingly.

SUMMARY OF THE INVENTION

One of the objects of the present invention is therefore to provide a method and a device for processing a photographic film in which the recovery and processing of the waste water does not pose the problems mentioned above.

Other objects still will emerge in detail from the following description.

These objects are achieved according to the invention by producing a method of processing a photographic film comprising the following steps:

a) passing the film through a series of processing baths, each of the baths having a rinsing zone including one or more tanks;

b) recovering the waste water coming from all the rinsing tanks in one and the same nanofiltration device common to all the processing baths; and c) recycling the permeate coming from the said nanofiltration device in each of the rinsing zones of each of the processing baths.

Advantageously the last tank in the last processing bath is fed with clean water from an auxiliary source.

According to another aspect of the present invention, an installation is produced for processing a photographic film comprising:

a) a plurality of processing baths through which the film passes successively, each of the baths having a rinsing zone including one or more tanks;

b) a nanofiltration device common to all the processing baths and designed to receive and treat the waste water coming from all the rinsing zones; and c) means for recycling the permeate coming from the said nanofiltration device in each of the rinsing zones of each of the processing baths.

Advantageously, the installation according to the invention also comprises means for supplying with clean water the last tank in the last rinsing zone through which the film passes.

According to another alternative, a tank is provided for receiving the residue coming from the nanofiltration device, the said installation also comprising an electrolysis unit for recovering the silver present in the residue.

BRIEF DESCRIPTION OF THE DRAWINGS

FIG. 1 is a preferred embodiment of the device for implementing the method according to the invention.

In the following description, reference will be made to the single figure of the drawing, which depicts diagrammatically a preferred embodiment of the device for implementing the method according to the invention.

DETAILED DESCRIPTION OF THE INVENTION

As illustrated, the device according to the invention comprises a system 1 for feeding photographic film 2 inside which the film is kept away from light. The film is then brought into a preliminary bath 3 (typically carbonate or sulphate), at the discharge from which the film passes into a system 4 enabling the carbon black situated on the back of the film to be removed. Generally such a system uses water jets whose action can be combined with the action of brush rollers.

The film is then introduced into a first processing bath 5 comprising a development bath 51 and a development-stop bath 52 for stopping the color development reaction. The processing bath 5 also comprises a rinsing zone 53 including one or more rinsing tanks (typically 2).

The film is then brought into a first fixing bath 6 comprising a first zone 61 where the film is brought into contact with the fixer and a rinsing zone 62 also including one or more tanks through which the film passes successively.

After the first fixing bath, the film passes through a bleaching bath 7 including a first series of tanks 71 containing a bleaching accelerator, a second series of tanks 72 including the bleaching agent and a third series of tanks 73 containing water intended for rinsing the film.

According to the type of film to be developed, the latter can then be routed to a station 90 where a developer is applied for developing the soundtrack, and then to a rinsing station 91.

At this stage, the film passes into a second fixing bath 8 including a first zone 81 where the film is brought into contact with a second fixer and a rinsing zone 82 also including two tanks.

In all the rinsing zones in the installation, the rinsing can be effected either with the flow or against the flow.

The configuration of the baths which has just been given above is given only as an indication. It is obvious that, with other types of film (positive color film, negative color film, black and white film, etc), other configurations may be used.

After the development proper, the film is routed to a drying station 92 after passing through a solution of surfactant and biocide intended amongst other things to prevent bacterial growth and, in general terms, to prepare the drying.

According to an important characteristic of the present invention, the waste water contained in the rinsing zones 53, 62, 73, 82 (and optionally 91) are recovered in order to be sent into a nanofiltration unit 100 common to all the processing baths 5, 6, 7, 8. Typically the routing to the nanofiltration unit takes place through a buffer reservoir 101, valves 102 and suitable pumps 103.

According to the embodiment illustrated, the residue (or filtration residue) is returned (line 104) to the buffer reservoir. Advantageously, the buffer reservoir includes conductimetry means (not depicted) for measuring the concentration of the solution in the reservoir 101 and discharging part of its contents when the conductimetry reaches or exceeds a given value, a valve being provided for discharging the excess. When the content of the reservoir is sufficiently concentrated, it can be processed by electrolysis 105 in order to recover the silver, for example.

The nanofiltration unit 100 may comprise a single membrane, or a plurality of membrane modules in series, each of the modules comprising one or more membranes in parallel according to the separation levels and flow rates desired. By way of indication, good results have been obtained with a nanofiltration membrane sold by Kiryat Weizmann Ltd under the reference MPSW-11.

According to another important characteristic of the invention, the permeate (line 106) produced by the nanofiltration unit. 100 is sent into each of the rinsing zones 53, 62, 73, 82. By way of example, the recirculation circuit comprises a valve 96, a buffer reservoir 94 and a pump 95. Unlike the example depicted, the water produced by the nanofiltration membrane 100 could also be recycled in the rinsing zone of the soundtrack development station. Inside each of the rinsing zones, the water coming from the unit 104 may be introduced equally well into any one of the rinsing tanks (including several or even all of them). Preferably, however, in the last rinsing zone 82 of the last processing bath 8, the permeate is recycled in all of the tanks 820 other than the last one 821, which is fed with clean water from an auxiliary source 107. A commonly accepted definition of the concept of clean water is given for information in Photographic Science and Engineering, Vol 9, No 6, November–December 1965, pages 398–413. Examples of proportions of different compounds in clean water are given in this extract. This approach makes it possible to have a last rinsing tank which is always clean, which limits the entrainment of chemical products from one bath to another and, in the case of use for the last processing bath of the photographic development process, of preserving the physical and sensitometric characteristics of the film with a view to better keeping over time. The quantity of water added depends partly on the level of residue in the nanofiltration device. For example, in the case of a filtration process with an output of 80% and a residue level of 20%, 20% water is added.

In the embodiment described above, a single nanofiltration unit is associated with the entire processing line of a given photographic product, each processing line being associated with one nanofiltration unit. According to another implementation of the concept of the invention, and in the case, for example, of a processing laboratory having different development installations for different types of film (a first installation for black and white film, a second for color negative film, a third for color positive film, etc) it is possible to configure the system so as to associate one nanofiltration unit with all the processing baths of the same type in the different processing lines. Thus, for example, the waste water from the fixing bath in the black and white film processing installation, the waste water from the fixing bath in the color positive film processing installation and the waste water from the fixing bath in the color negative film processing installation will be recovered by one and the same nanofiltration unit, it being possible to recycle the permeate in each of the processing baths in one or other of these three installations.

The advantage of the latter approach lies in the fact that the residue (or concentrate) produced by the nanofiltration unit associated with all the fixing baths can, after chemical adjustments, be used for regenerating with fixing agent the fixing bath in one or other of the installations. The same thing can be done for other types of bath with other types of film, the concept common to all these approaches being that the same nanofiltration unit is associated with several processing baths, and that the permeate produced by this nanofiltration unit common to several baths can be recycled in any bath in the processing machine.

Another major advantage of all these approaches relates to the saving in washing water which they make it possible to achieve.

The invention has just been described with reference to preferred embodiments. It is evident that variants can be made thereto without departing from the concept of the invention as claimed hereinafter.

We claim:

1. Method for processing a photographic film comprising the following steps:

a) circulating the film (2) in a series of processing baths (5, 6, 7, 8), each of the baths including a rinsing zone (53, 62, 73, 82) including one or more tanks;

b) recovering and treating the waste water coming from all the rinsing zones in a single nanofiltration device (100), common to all the processing baths; and c) recycling the permeate (106) from said nanofiltration device (100) in each of the rinsing zones (43, 62, 73, 82) of each of the processing baths (5, 6, 7, 8).

2. Method according to claim 1, in which the last tank (821) of the last processing bath (8) in which the film (2) passes is fed with clean water from an auxiliary source (107).

3. Method according to claim 1 or 2, in which the photographic film (2) is caused to circulate successively in a development bath (5), a first fixing bath (6), a bleaching bath (7) and a second fixing bath (8).

4. Installation for processing a photographic film comprising:

a) a plurality of processing baths (5, 6, 7, 8) in which the film (2) circulates successively, each of the baths including a rinsing zone (53, 62, 73, 82) including one or more tanks;

b) a nanofiltration device (100) common to all the processing baths (5, 6, 7, 8) and intended to receive and treat the waste water coming from all the rinsing zones (53, 62, 73, 82); and c) means (94, 95) for recycling the permeate (106) from said nanofiltration device (100) in each of the rinsing zones (53, 62, 73, 82) of each of the processing baths (5, 6, 7, 8).

5. Installation according to claim 4, also comprising means (107) for supplying with clean water the last tank (821) in the last rinsing zone (82) of the last processing bath (8) in which the film circulates.

6. Installation according to claim 4, in which said plurality of baths comprises a developing bath (5), a first fixing bath (6), a bleaching bath (7) and a second fixing bath (8).

7. Installation according to claim 4, also comprising a tank (101) for receiving the residue (104) from the nanofiltration device (100), said installation also comprising an electrolysis unit (105) for recovering the silver present in the residue.

* * * * *